US005488806A

United States Patent [19]

Melnick et al.

[11] Patent Number: 5,488,806

[45] Date of Patent: Feb. 6, 1996

[54] BLOCK FORMS FOR RECEIVING CONCRETE

[76] Inventors: David W. Melnick, 3405 Alcott St., Denver, Colo. 80211-3341; Robert T. Barnet, 809 E. Ridgecrest Rd., Fort Collins, Colo. 80524

[21] Appl. No.: 119,492

[22] Filed: Sep. 9, 1993

[51] Int. Cl.[6] ..... E04C 2/26; E04B 2/44

[52] U.S. Cl. ..... 52/425; 52/295; 52/293.3; 52/309.7; 52/309.12; 52/424; 52/426; 52/431; 52/562; 52/127.2

[58] Field of Search ..... 52/295, 293.3, 52/309.7, 309.12, 424, 425, 426, 431, 561, 562, 127.2

[56] References Cited

U.S. PATENT DOCUMENTS

| | | | |
|---|---|---|---|
| 1,732,243 | 10/1929 | Nelson | 52/424 |
| 3,574,981 | 4/1971 | Henschen | 52/127.2 |
| 3,788,026 | 1/1974 | Cook | 52/127.2 |
| 3,950,902 | 4/1976 | Stout | 52/295 X |
| 4,038,798 | 8/1977 | Sachs . | |
| 4,532,745 | 8/1985 | Kinard . | |
| 4,604,843 | 8/1986 | Ott et al. | 52/562 X |
| 4,823,534 | 4/1989 | Hebinck . | |
| 4,924,641 | 5/1990 | Gibbar, Jr. | 52/295 X |
| 4,967,528 | 11/1990 | Doran | 52/309.12 |
| 5,038,541 | 8/1991 | Gibbar, Jr. | 52/295 |
| 5,040,344 | 8/1991 | Durand | 52/127.2 |
| 5,339,592 | 8/1994 | Schmid | 52/309.12 |

*Primary Examiner*—Wynn E. Wood
*Attorney, Agent, or Firm*—Sheridan Ross & McIntosh

[57] ABSTRACT

A foam block wall system is formed from a plurality of interconnected individual foam blocks. The individual foam blocks have a plurality of vertically oriented, quadrilateral core members spaced evenly within the block. The spaces between the core members define a plurality of vertically oriented chambers which receive liquid concrete.

A plurality of connectors serve to connect the individual blocks into an integrated structure. A generally U-shaped bracket is secured to the floor or other supporting structure to provide support for the bottom layer of blocks. A generally H-shaped connector rests between successive vertical layers to provide both vertical and lateral stability. Generally U-shaped connectors connect adjacent blocks to provide vertical and lateral stability. A cabling system secures the individual blocks to the floor, also providing vertical and lateral support.

11 Claims, 10 Drawing Sheets

BLOCK FORMS FOR RECEIVING CONCRETE

FIELD OF THE INVENTION

This invention relates to building and housing construction. More specifically, this invention relates to a construction technique which employs a system of interconnected blocks as forms to construct concrete walls.

BACKGROUND

As practiced in the field, foam block construction techniques typically employ a system of plastic foam blocks interconnected by various means to form an integrated structure for receiving liquid concrete. Each block contains a plurality of internal channels to receive liquid concrete. The concrete, upon hardening, provides structural integrity to support the wall. The plastic foam blocks initially act as a structure to retain the liquid concrete. After the concrete has hardened, the plastic blocks remain an integral element of the wall, providing thermal insulation and a smooth surface to which drywall, siding, or other finishes can be attached.

A common means of interconnection is a tongue and groove system, in which the individual blocks are formed with interlocking configurations on their edges. The interlocking edges allow the foam blocks to be assembled into an integrated structure before the liquid concrete is poured into the blocks.

The prior art teaches the use of different materials for the construction of such blocks. Expanded polystyrene (EPS) foam is one favored material for constructing such blocks because it exhibits several important materials characteristics. EPS is easily formable into blocks which possess sufficient strength and rigidity to retain liquid concrete while remaining sufficiently light to be handled manually. EPS provides a high degree of thermal insulation. Furthermore, EPS can be produced to provide a cost-effective alternative to other wall construction techniques.

Such foam block construction techniques have gained limited commercial success. However, certain disadvantages and limitations inherent in the design of prior foam block systems have inhibited the wide-scale commercial use of foam block wall systems.

A principal limitation of such wall systems has been the inability of the means of interconnection to maintain the proper alignment of the individual blocks within the wall system when liquid concrete is poured into the blocks. The pressure of the liquid concrete tends to force the individual blocks out of proper alignment within the integrated wall system. Experience demonstrates that individual blocks are susceptible to misalignment along all three axes. For example, adjacent blocks may buckle or sway under the weight of the concrete, resulting in a wall that is not straight along the horizontal axis. Similarly, if the wall requires blocks to be stacked more than one layer high, the second layer may sway or float, resulting in a wall that is not straight along the vertical axis. The time and expense associated with remedial measures to correct these alignment problems may eliminate any cost advantage derived from the use of foam block systems.

A second limitation is presented when the blocks are designed with interfitting means, such as interlocking tongues and grooves on the edges. If a block is cut or trimmed to a different size, the interlocking edge is lost in the cut. Special operations are then required to create a new interlocking edge. These operations increase construction time and expense.

A further limitation of prior foam block wall systems is the difficulty of attaching structural or external members to the finished wall structure. The foam block surface provides a smooth, flat surface to which drywall or other lightweight finishing materials may be adhesively attached. However, if building codes or structural requirements preclude the use of adhesives, it is necessary to cut away the foam to gain access to the concrete members which provide structural support. This operation results in increased building costs and time.

SUMMARY OF THE INVENTION

The present invention is directed toward providing a foam block wall system, a method for manufacturing individual foam blocks, and interconnectors to provide an efficient and effective means of constructing foam block concrete walls. The invention encompasses the particular design of the individual foam blocks, the method of manufacture of the individual foam blocks, the various interconnectors for the individual foam blocks, and the method of interconnecting the individual foam blocks into an integrated wall system.

The individual blocks of the present invention include a front and back panel of plastic foam. A plurality of quadrilateral core members are affixed to the front and back panel, thereby forming a block with length, height, and thickness dimensions. The core members are spaced within the block to define a plurality of vertically oriented quadrilateral chambers spanning the height of the block which may receive and confine liquid concrete. The core members and the front and back panels cooperate to form a horizontal chamber which spans the length of the block along its top. The front and back panels define the sides of the horizontal chamber and the core members define the bottom of the horizontal chamber.

A number of interconnectors for the individual blocks to form an integral block wall system are provided. Vertical connectors interconnect the blocks in the vertical plane. Lateral connectors interconnect the blocks in the horizontal plane. These connectors may be employed to ensure that each block within the wall system remains properly aligned after the concrete is poured into the finished wall structure.

Also provided in the design are a number of exterior panel connectors which allow external panels such as drywall, siding, or other finishing materials, to be secured to the completed wall.

The preferred method of manufacturing the individual blocks involves first cutting the core members to the appropriate dimensions from a sheet of EPS foam. Adhesive is then applied to the core members and to two sheets of EPS foam. The core members are positioned appropriately between the two sheets of EPS foam and the adhesive is allowed to cure, thereby forming a block.

The preferred method of constructing a wall from the EPS foam blocks involves first arranging the bottom vertical layer of the blocks according to the specifications required for the wall. Reinforcing rod is situated within the chambers according to specifications. Liquid concrete is then poured into the chambers of the blocks and is allowed to fill both the vertical and horizontal chambers of the block. Each block is held secure and plum by a cabling or a turnbuckle system which is secured to a vertical connector. After the bottom vertical layer has been filled with concrete, the next vertical layer is positioned on top of the bottom layer. The second layer is secured and filled using the same process as the bottom layer. This process is repeated until the wall reaches the desired height.

DETAILED DESCRIPTION

Figure 1:
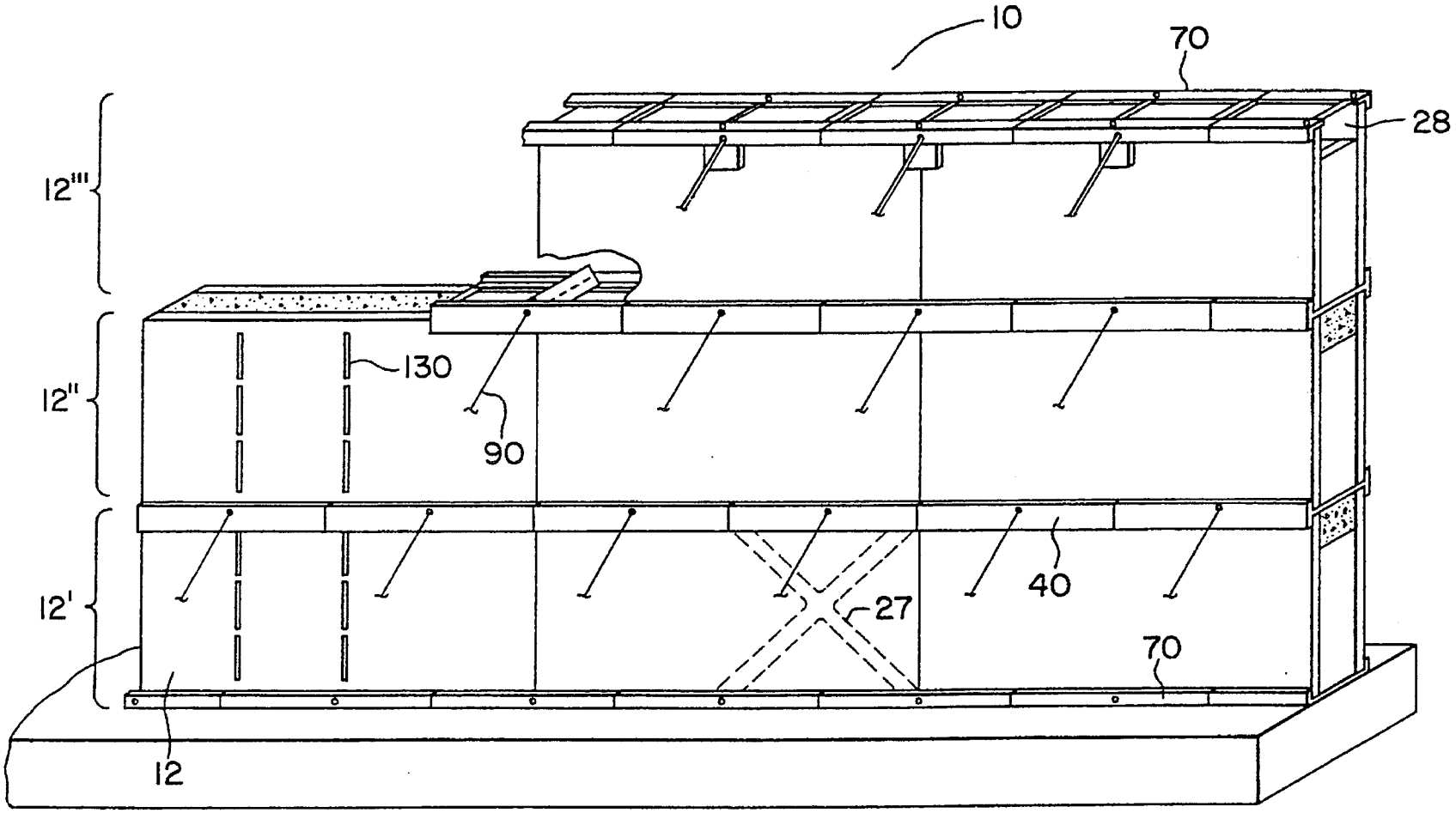
FIG. 1 is a perspective view of a wall structure formed by assembling a plurality of EPS blocks, with the wall section of FIG. 1 illustrating eight interconnected blocks, however it will be appreciated that more or fewer blocks could be used.

A preferred embodiment of the foam block wall system manufactured in accordance with the present invention is shown in FIG. 1. The wall system 10 comprises a plurality of individual EPS foam blocks 12 interconnected in both the lateral and vertical planes to form an integrated wall structure 10. In the preferred embodiment, the blocks 12 are connected in the vertical plane using vertical connectors 40, 70, and are connected in the horizontal plane using lateral connectors 100. In the preferred embodiment, the wall structure 10 is built up from the ground in successive horizontal layers 12', 12", 12'".

Figure 2:
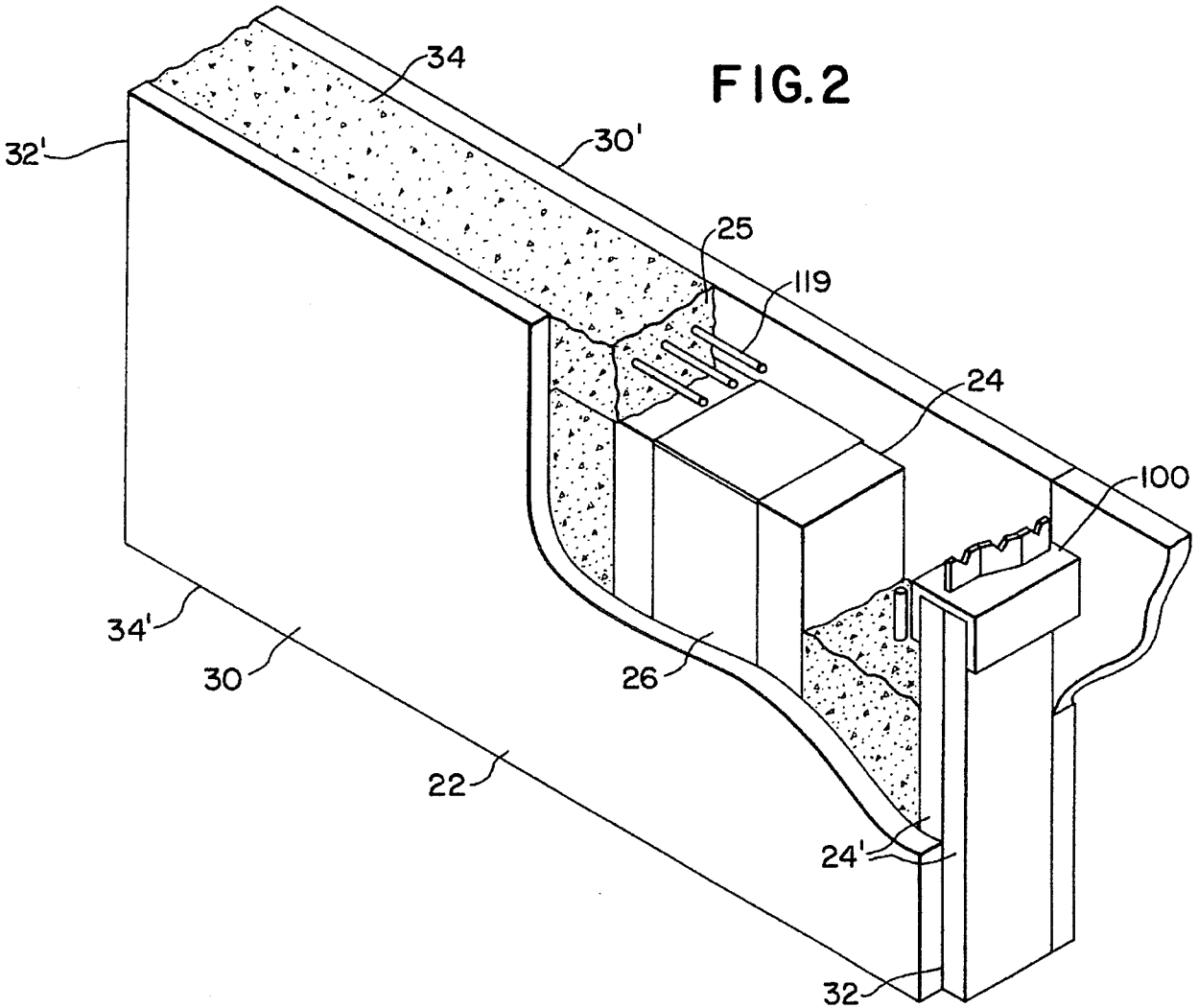
FIG. 2 is a perspective view of a single foam block formed in acccordance with the present invention.

As shown in FIGS. 1 and 2, the preferred form of a block 12 in accordance with the present invention includes first and second panels 22. The panels are preferably of a right rectangular shape. In the preferred embodiment, a plurality of quadrilateral core members 24 are affixed to the first and second panels, thereby forming a block with length, width, and depth dimensions. The core members 24 are uniformly spaced within the block 12 to define a plurality of vertically oriented quadrilateral chambers 26 within the block 12 which may receive liquid concrete 25. In the preferred embodiment, the core members 24 are also shorter in height than the first and second panels 22. The core members 24 thereby cooperate with the first and second panels 22 to form a horizontal chamber 28 at the top of the block which may receive liquid concrete 25. Where additional structural support is required for protection against wind or seismic shock, the core members 24 may also be cut to define an additional X-shaped channel 27 to receive liquid concrete 25.

The first and second panels 22 cooperate to define the front wall 30 and back wall 30' of the block 12. The outermost core member 24' on each side of the block cooperates with the front wall 30 and back wall 30' to define the side walls 32, 32' of the block 12. The top surface 34 of the block is defined by the horizontal plane along the uppermost surfaces of the front wall 30 and back wall 30'. The bottom surface 34' of the block 12 is defined by the plane along the lowermost surfaces of the front wall 30 and back wall 30'.

The length of the block 12 is defined by the distance between the exterior surfaces of side walls 32 and 32'. The height of the block is defined by the distance between the top surface 34 and lower surface 34' of the block. The thickness of the block is defined by the distance between the exterior surfaces of the front wall 30 and back wall 30'. In the preferred embodiment, the exterior surface of the front wall 30, back wall 30', and both side walls 32' of the block 12 is smooth and flat.

In the preferred embodiment, the first and second panels 22 and core members 24 of the block 12 are formed from expanded polystyrene (EPS) foam. EPS foam is the preferred material for construction of the blocks because it is easily formable into blocks which possess sufficient strength and rigidity to retain liquid concrete while remaining sufficiently light to be handled manually. EPS foam also provides a high degree of thermal insulation. Furthermore, EPS can be produced to provide a cost-effective alternative to other wall construction techniques.

The preferred embodiment includes a number of different connectors for interconnecting the individual blocks 12 into an integrated wall structure 10. Vertical connectors 40 rest between successive vertical layers of blocks. Lateral connectors 100, 170 connect adjacent blocks in the lateral plane. When used in conjunction with one another, the connectors connect the blocks into an integrated wall structure 10 and prevent laterally adjacent blocks from shifting horizontally or vertically with respect to one another. The connectors remain an integral part of the wall structure 10 after the concrete 25 has solidified.

Figure 4A:
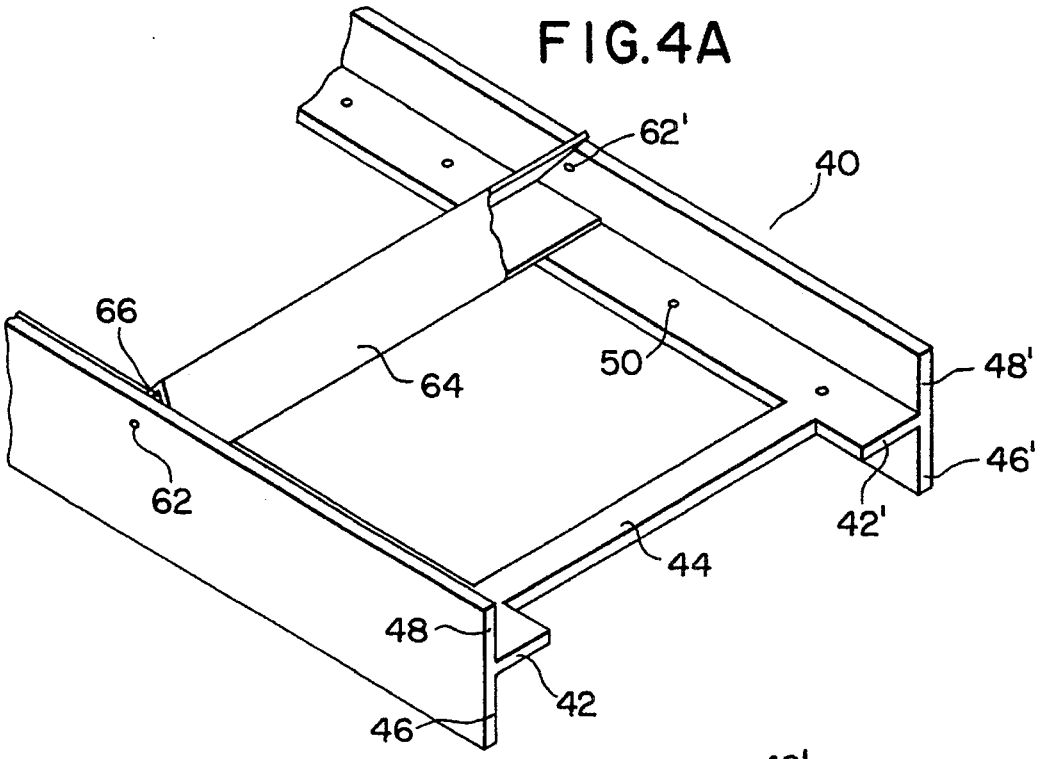
FIG. 4A is a perspective view of a section of a vertical connector.
Figure 4B:
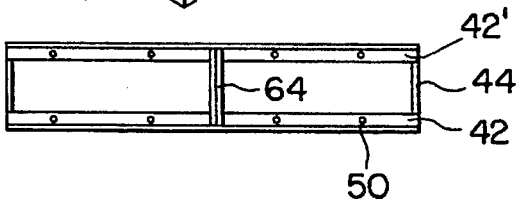
FIG. 4B is a horizontal view of a vertical connector.

Two types of vertical connectors are provided in the preferred embodiment. FIGS. 4A and 4B illustrate the first vertical connector 40. The first vertical connector 40 comprises a first support rail 42 and second support rail 42' connected by a plurality of cross members 44, a first lower retaining member 46 and second lower retaining member 46', and a first upper retaining member 48 and second upper retaining member 48'. First and second lower retaining members 46, 46' extend downward in the vertical plane from the outermost surfaces of the first and second support rails 42, 42', respectively. First and second upper retaining members 48, 48' extend upward in the vertical plane from the outermost surfaces of the first and second support rails 42, 42', respectively. The first and second support rails 42, 42' preferably contain a plurality of openings 50 to receive fasteners.

The preferred embodiment of the first vertical connector 40 includes opposing holes 62, 62' in the first and second upper retaining members 48, 48' and a three-sided cross member 64 defining a triangular-shaped inner chamber 66 stretching between the opposing holes 62, 62' for attaching external support members to the vertical connector 40.

Figure 5A:
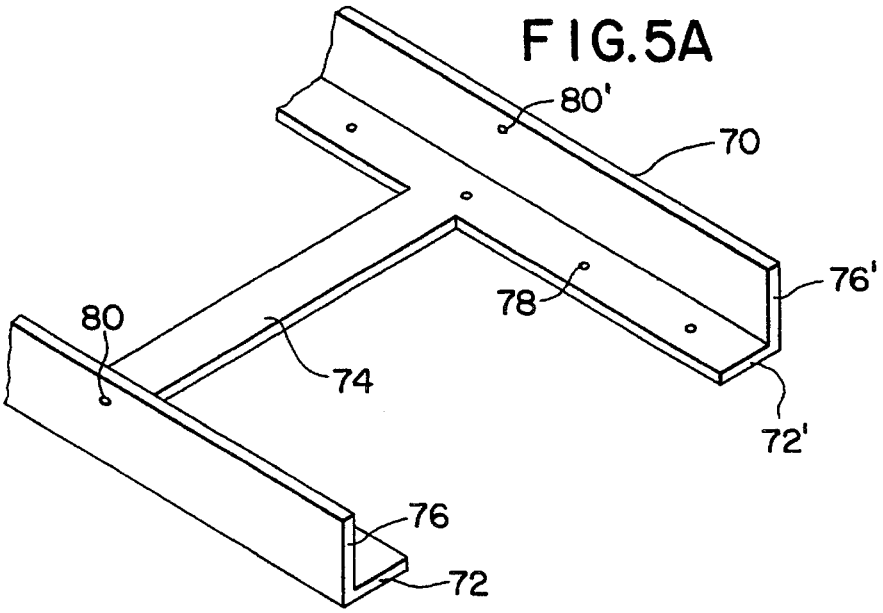
FIG. 5A is a perspective view of a section of a vertical connector.
Figure 5B:
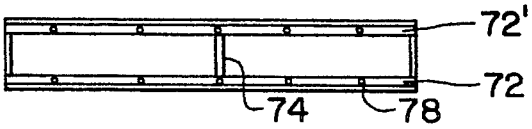
FIG. 5B is a horizontal view of a vertical connector.

FIGS. 5A and 5B illustrate the preferred embodiment of the second vertical connector 70. The second vertical connector 70 comprises first and second lateral support rails 72, 72' connected by a plurality of cross members 74, first restraining member 76 and a second restraining member 76'. The lateral support rails 72, 72' include a plurality of holes 78 through which fasteners may be extended. The first and second restraining members 76, 76' include at least one pair of opposing holes 80, 80' which may receive fasteners to attach external support members.

Figure 3:
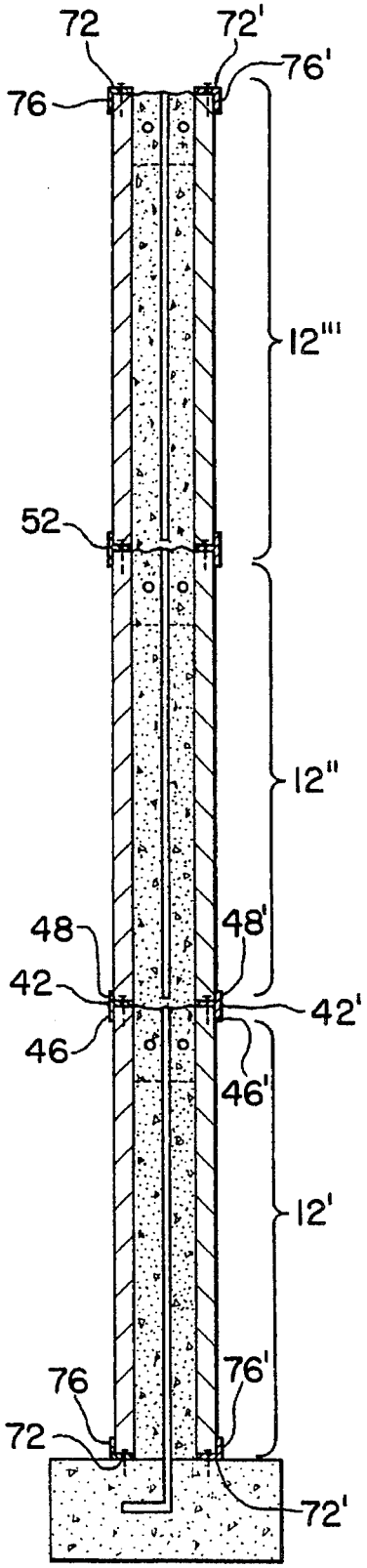
FIG. 3 is a vertical section view viewed along the longitudinal axis of FIG. 1, illustrating the use of vertical connectors to connect the blocks in the vertical plane.

FIGS. 1 and 3 provide an illustration of the vertical connectors 40, 70 as elements of an interconnected wall structure 10. The first vertical connector 40 rests between and connects successive vertical layers of the wall 12', 12", 12'". The first and second support rails 42, 42' rest generally on the uppermost horizontal surface of the front wall 30 and the back wall 30' of the lower block 12'. The first and second support rails 42, 42' preferably contain a plurality of openings 50 through which fasteners 52, such as nails, may be driven into the front wall 30 and back wall 30' of the lower block 12', thereby securing the vertical connector 40 to the lower block 12'. The first and second lower retaining members 46, 46' extend downward along the exterior surface of the front and back walls 30, 30' of the lower block 12'. The first and second upper retaining members 48, 48' extend upward along the exterior surface of the front and back walls 30, 30' of the upper block 12". This process is repeated as the wall is built up in successive layers.

The second vertical connector 70 attaches to the floor to provide a channel in which the bottom surface of the first vertical layer of blocks 12' rests. The connector is secured to the floor by driving fasteners 52 through the holes 78 in the first and second support rails 72, 72'. Retaining members 76, 76' extend upward along the exterior surface of the front and back walls 30, 30', respectively, of bottom layer of blocks 12', thereby preventing the blocks from deviating from proper alignment along the length of the wall 10.

The second vertical connector 70 also attaches to the top surface of the top block 12'" of the wall structure 10. The connector is secured to the block by driving fasteners 52 through the holes 78 in the first and second support rails 72, 72'. Retaining members 76, 76' extend downward along the exterior surface of the front and back walls 30, 30', respectively, of top layer of blocks 12', thereby preventing the blocks from deviating from proper alignment along the length of the wall 10.

The vertical connectors 40, 70 also act to secure each block 12 to the floor or other appropriate support structure. A cable 90 is the preferred method to secure blocks at heights up to eight feet. The cable 90 is secured to the ground or other structure on one side of the wall and is directed through the opposing holes 62, 62' and triangular-shaped chamber 66 defined by the three-sided cross member 64 in the vertical connector 40. The cable 90 is then secured to the ground or other structure on the opposite side of the wall 10. A turnbuckle (not shown) is the preferred method of securing blocks at heights exceeding eight feet. One end of the turnbuckle is secured to the floor or other support structure on one side of the wall 10. The opposite end is secured to the vertical connector 70 using a bolt or other fastener.

The cables 90 and turnbuckles prevent the blocks 12 from floating on the liquid concrete 25 and from deviating from their proper alignment within the wall system when it is poured into the channels 24 of the blocks. The cables 90 and turnbuckles also ensure that the successive layers 12', 12", 12'" of the wall 10 remain vertically plumb as the wall 10 is built up.

It should be appreciated that the vertical connectors 40, 70 may also be used to connect individual blocks 12 in the lateral dimension. As illustrated in FIG. 1 a vertical connector 40, 70 may be used to bridge the connection between two adjacent blocks 12, thereby preventing the lateral displacement of adjacent blocks 12.

Figure 6A:
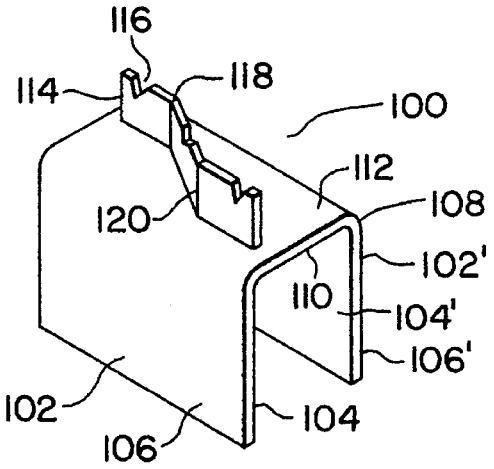
FIG. 6A is a perspective view of an upper lateral connector.

FIG. 6A is a perspective view of the upper lateral connector 100. The upper lateral connector 100 comprises a substantially U-shaped bracket having a first leg 102 and a second leg 102', each leg having an interior surface 104, 104' and an exterior surface 106, 106'. A platform member 108 connects the first and second legs at one end, forming a U-shaped bracket. The platform member 108 also has an interior surface 110 and exterior surface 112. A reinforcing rod holder 114 rises in a plane perpendicular to the exterior surface 112 of the connecting platform member 108. In the preferred embodiment the reinforcing rod holder 114 is a single member which includes a plurality of notches 116 cut into the top which allow reinforcing rod 119 to rest horizontally in the notches. The reinforcing rod holder 114 is preferably formed with two opposing bends 118, 120 of equal obtuse angles to form an offset shape. The offset shape provides structural integrity in the horizontal plane.

FIG. 2 illustrates the use of the upper lateral connector 100 to provide a horizontal connection between two adjacent blocks 12. The upper lateral connector fits snugly over the two outermost core members 24' which form the side walls 32, 32' of the adjacent blocks. The platform member 108 covers the top of the adjacent core members. The legs 102, 102' of the lateral connector fit snugly against the sides of the adjacent core members 24', extending downward in the vertical plane. The reinforcing rod holder 114 extends upward in the vertical plane from the platform member 108.

Figure 6B:
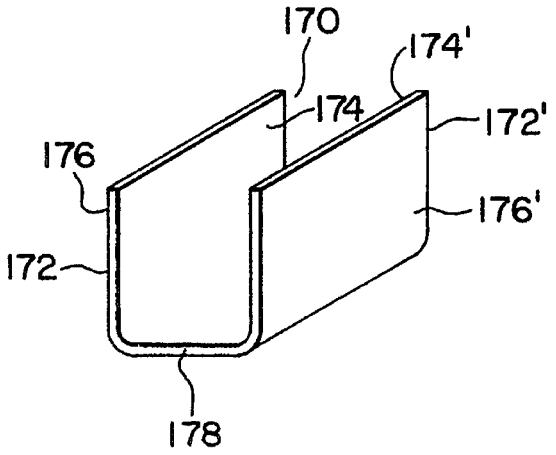
FIG. 6B is a perspective view of a lower lateral connector.

FIG. 6B is a perspective view of a lower lateral connector 170. The lower lateral connector 170 comprises a substantially U-shaped bracket having a first leg 172 and a second leg 172', each leg having an interior surface 174, 174' and an exterior surface 176, 176'. A platform member 178 connects the first and second legs at one end, forming a U-shaped bracket. The platform member 178 also has an interior surface 180 and exterior surface 112. The lower lateral connector 170 fits snugly over the bottom of the two outermost core members 24' which form the side walls 32, 32' of the adjacent blocks. The platform member 178 covers the bottom of the adjacent core members. The legs 172, 172' of the lateral connector 170 fit snugly against the sides of the adjacent core members 24', extending upward in the vertical plane. The lateral connectors 100, 170 prevent the lateral displacement of adjacent blocks 12.

Figure 7:
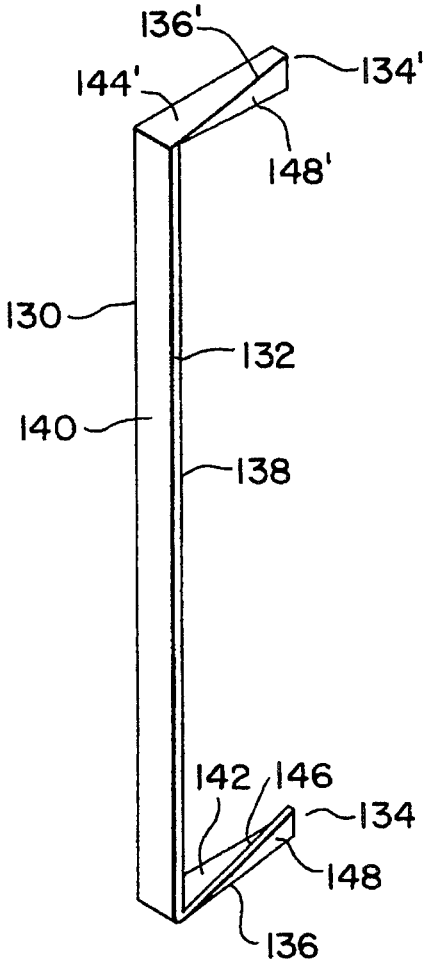
FIG. 7 is a perspective view of an external panel connector.

FIG. 7 illustrates an exterior panel connector 130 as provided in the preferred embodiment. In its preferred form, each external panel connector 130 is a C-shaped bracket formed from a single length of steel approximately twenty inches in length and two inches in width, however it will be appreciated that steel or other materials of various gauges and lengths may be used to form the bracket. The single length of steel is bent to ninety degree angles at points approximately four inches from each end, forming a C-shaped bracket with a base 132 of approximately twelve inches in length and two legs 134, 134' approximately four inches in length. The base has an interior surface 138 and an exterior surface 140. Each leg has a first interior surface 142, 142' and a first exterior surface 144, 144'. Each leg 134, 134' also includes a ninety degree bend 136, 136' extending along a line beginning at the intersection of the base 132 and the leg 134, 134' and extending at an acute angle toward the end of the leg. The ninety degree bend 136, 136', forms a second interior surface 146, 146' and a second exterior surface 148, 148' of the leg 134, 134' in a plane substantially perpendicular to the plane defined by the first interior surfaces 142, 142' and first exterior surfaces 144, 144'. The perpendicular orientation of the surfaces on the legs 134, 134' provides structural support to prevent the legs 134, 134' from buckling under the pressure of the liquid concrete when it is poured into the blocks.

FIG. 1 illustrates the use of exterior panel connectors 130 in a wall system 10. The legs 134, 134' of the connector 130 are forced through the side panel 22 of the block 12 into the void of a vertical chamber 26 with the base 132 of the connector 130 oriented in a substantially vertical position. The interior surface 138 of the base 132 fits snugly against the side panel 22 of the block 12. The exterior surface 140 of the base 132 faces outward from the surface of the side panel 22. In the preferred embodiment a plurality of exterior panel connectors 130 are placed at regular vertical and horizontal intervals in the wall 10 as illustrated in FIG. 1. When the concrete in the vertical chambers 26 solidifies around the legs 134, 134' of the connectors 130, the connectors 130 are securely fastened to the structure of the wall 10. External members such as siding, drywall, or other finishing materials can be attached to the exposed exterior surface of the base 140 of the external panel connectors 130 by using screws or other like fasteners.

Figure 8:
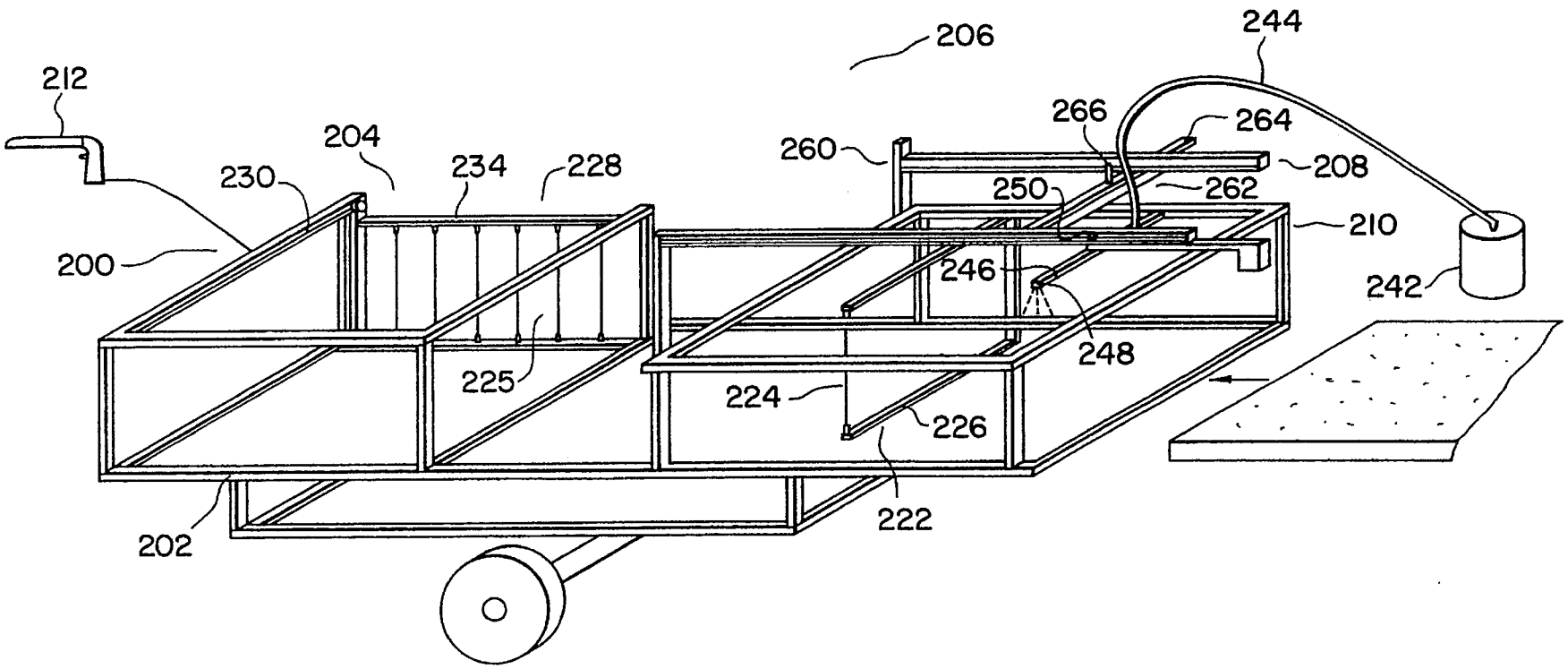
FIG. 8 is a perspective view of a block forming apparatus.

The present invention also encompasses a method of forming the individual EPS foam blocks 12 using a block forming apparatus 200. FIG. 8 is a perspective view of the preferred form of a block-forming apparatus 200. In its preferred form, the block forming apparatus 200 is a mobile fabricator comprising a frame 202, an EPS foam cutting assembly 204, an adhesive assembly 206, a roller assembly 208, an assembly area 210, and a portable hand cutter 212. The mobile fabricator can be easily pulled behind a pickup truck or other vehicle to a construction site, where individual blocks 12 can be formed on-site in accordance with the requirements of the particular job.

Figure 9B:
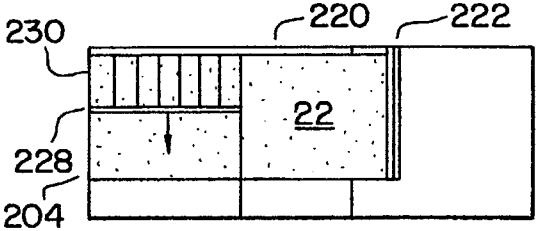
FIGS. 9A, 9B, 9C are schematic, top elevational views of the cutting assembly in operation.
Figure 9A:
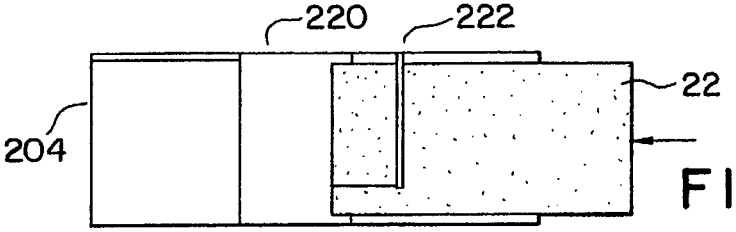
Figure 9C:
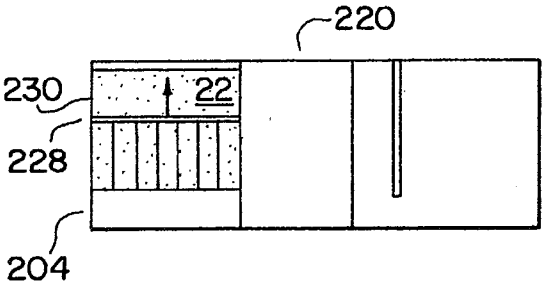

The first step in forming an EPS foam block 12 according to the present invention is to form the quadrilateral shaped core members 24. This is accomplished using the EPS cutting assembly 220. The EPS cutting assembly 220 comprises two separate hot-wire cutting units. The first hot-wire cutting unit 222 comprises a single wire 224 stretched vertically between the arms of a C-shaped frame 226. The second hot-wire cutting unit 228 comprises a plurality of wires 225 stretched vertically between the arms of a second C-shaped frame 234. The second hot-wire cutting unit 228 is mounted on a track 230 which allows the unit to move relative to the fixed frame 202 of the block forming apparatus 200. Electrical current is passed through the wires 224, causing them to heat. The heated wires 224 are used to cut the EPS foam. FIGS. 9A to 9C illustrate the process of forming the core members 24. An EPS foam sheet having length, height, and thickness dimensions is positioned horizontally on the frame 202 and is fed into the cutting assembly 220, the first hot-wire cutting unit 222 cuts a predetermined amount from the EPS foam block along its length dimension (FIG. 9A). When the end of the EPS foam sheet reaches the end of the cutting assembly 220, the second hot-wire cutting unit 228 cuts a plurality of EPS foam core members 24 from the sheet by moving on its track 230 across the height dimension of the EPS foam sheet (FIG. 9B). When the rest of the sheet is moved to the end of the cutting assembly 220 the second hot wire cutting unit 228 again moves on its track 230 along the height of the EPS foam sheet, again cutting a plurality of core members (FIG. 9C). The core members are removed and adhesive is applied to the appropriate sides of the foam cores 24.

Figure 10:
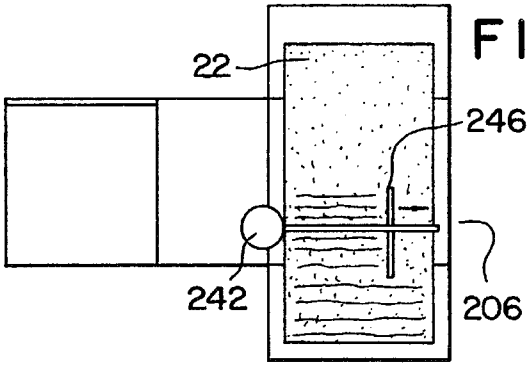
FIG. 10 is a schematic, top elevational view of the adhesive assembly in operation.

The next step in the process of forming EPS foam blocks according to the present invention is to apply adhesive to the inner surface of the side panels 22 using the adhesive assembly 206. The adhesive assembly 206 comprises a frame 240, an adhesive container 242, lines 244 for transporting the adhesive from the adhesive container 242 to a manifold 246, and a plurality of adhesive applicators 248 in cooperation with the manifold 246. In the preferred embodiment the adhesive applicators 248 are rolling instruments. However, it would be obvious to one skilled in the art that the adhesive applicators could be spray nozzles or other means. In the preferred embodiment, the manifold 246 and adhesive applicators 248 are mounted on a track 250 for relative movement in a horizontal direction with respect to the frame 240. FIG. 10 illustrates the process of applying adhesive to a side panel 22 using the adhesive assembly 206. A panel 22 with length, height, and thickness dimensions is positioned horizontally on the frame as illustrated in FIG. 10. The manifold 246 and adhesive applicators 248 move on the track 250 across the height dimension of the foam panel 22. The adhesive applicators 248 are spaced to apply a uniform layer of adhesive to the surface areas of the panel which will receive the foam core members 24.

Figure 11:
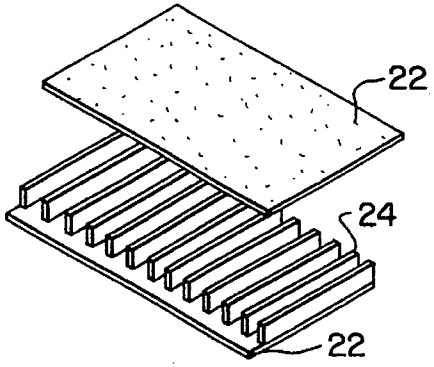
FIG. 11 is an exploded assembly view of a foam block.

The next step in forming an EPS foam block 12 in accordance with the present invention is to assemble the block. FIG. 11 illustrates an exploded assembly view of the block as it is assembled. A first EPS foam sheet having length, height, and thickness dimensions is positioned horizontally on the frame with the adhesive coated side facing upward. The quadrilateral core members 24 are affixed to the first EPS foam sheet 22 in the appropriate locations. A second EPS foam sheet 22 also having length, height, and thickness dimensions is positioned on top of the core members with the adhesive coated side facing downward to form the EPS block 12.

Figure 12:
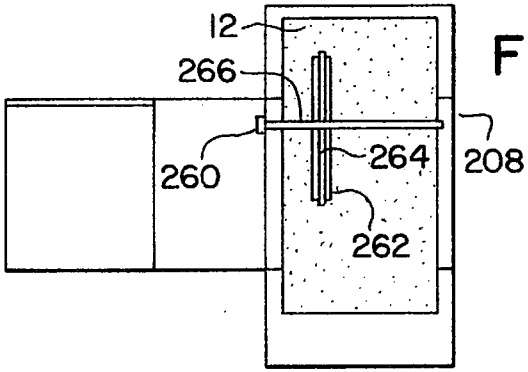
FIG. 12 is a schematic, top elevational view of the roller assembly in operation.

The final step in the block forming process is to roll the block using the rolling assembly 208. After the block 12 has been assembled, it is put through a rolling operation as illustrated in FIG. 12. The rolling assembly 208 comprises a fixed frame 260, and a roller 262 mounted on a frame 264, and a track 266 which allows the roller 262 to move relative to the fixed frame 260 in the horizontal plane. The assembled block 12 is placed in a horizontal position on the frame 202 underneath the rolling assembly 208. The roller 262 is mounted on the frame at spaces which correspond with the location of the core members 24 of the block. The roller 262 moves across the height dimension of the block 12, passing directly over and thereby compressing the core elements 24. The compression ensures that the adhesive is spread evenly on the surfaces of the core members 24 and the panels 22.

Figure 16:
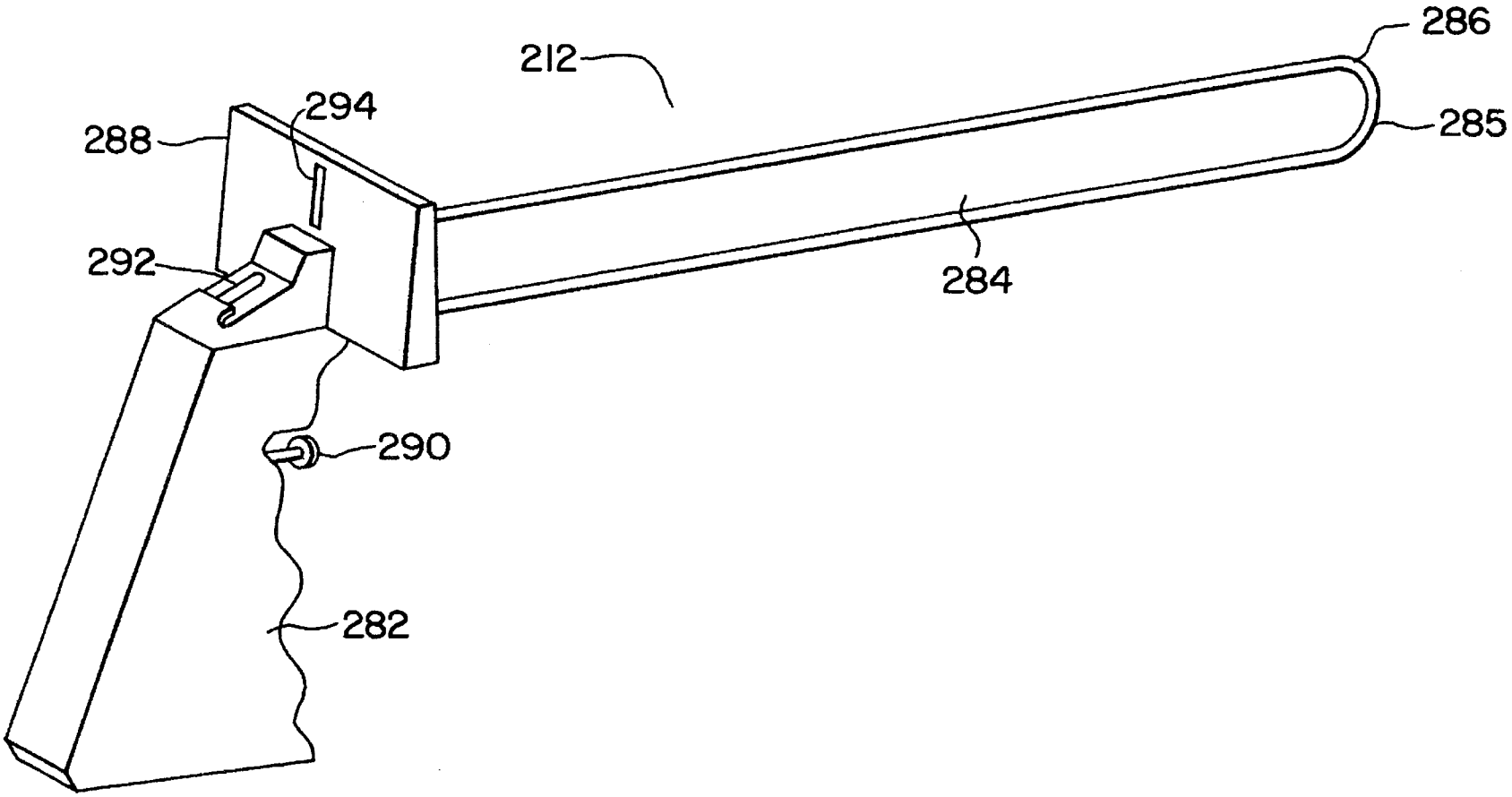
FIG. 16 is a perspective view of a portable hand cutter.

The block forming apparatus 200 also includes a portable hand cutter 212, as illustrated in FIG. 16, for cutting doors and windows, or otherwise cutting finished blocks 12. In its preferred embodiment, the portable hand cutter 212 includes a handle 282, a radially extending mounting member 284, a heating element 286 extending along the exposed edge surface or periphery 285 of the mounting member 284, a positioning member 288, and a switch 290. The handle 282 includes a turnbuckle 292 which assists in securing the heating element 286 to the exposed edge surface 285 of the mounting member 284. The mounting member 284 is preferably formed from a rigid dielectric material such as fiberglass or a plastics composite and measures approximately sixteen inches in length, two and one-half inches in height, and one-sixteenth inch in thickness. The heating element 286 is preferably formed from 26 gauge wire, which corresponds to the size of the wires 224, 225. The gauge of the heating element wire 226 is not greater than about 16 gauge so that too large a cut or hole is not produced when using the cutter 212. One end of the heating element 286 is secured to the handle 282 of the cutter 212 at the lower base of the mounting member 284. The heating element 286 is secured to the exposed edge surface 285 of the mounting member 284 by a thin layer of an adhesive, such as an epoxy. The other end of the heating element 286 is secured to the handle 282 using a turnbuckle 292 or other tightening means.

The portable hand cutter 212 is useful for cutting holes for doors and windows in finished blocks or otherwise cutting finished blocks 12. When switch 290 is triggered heating element 286 becomes hot enough to melt the EPS foam from which the blocks 12 are formed without physically contacting the foam, thereby forming a clean, smooth cut. In this manner the mounting member 284 can be extended through a block 12 until the positioning member 288 comes into contact with the surface of the block. The positioning member 288 includes a vertically oriented aperture 294 which assists the operator in guiding the cutter along a straight line to form a clean, smooth cut in the block 12.

The first step in constructing a wall or walls 10 according to the present invention is to form a sufficient number of EPS foam blocks 12 using the method outlined above. The second step is to secure lower vertical connectors 70 to the floor or other supporting structure in accordance with the layout specifications of the wall. The first vertical layer of EPS foam blocks 12' is positioned within the lower vertical connectors 70. Vertical connectors 40 are secured to the top horizontal surface of the first layer of blocks 12'. Lateral connectors 100, 170 are fitted over the outermost core members of laterally adjacent blocks 12. External panel connectors 130 are then attached to the blocks as required by specifications or as desired. The blocks are secured to the ground using cables 90 as described above. The first layer of blocks 12' is then filled with concrete 25. The second vertical layer 12" of EPS foam blocks is then positioned on top of the first layer 12' and the process is repeated until the wall 10 is of the desired height.

Figure 13:
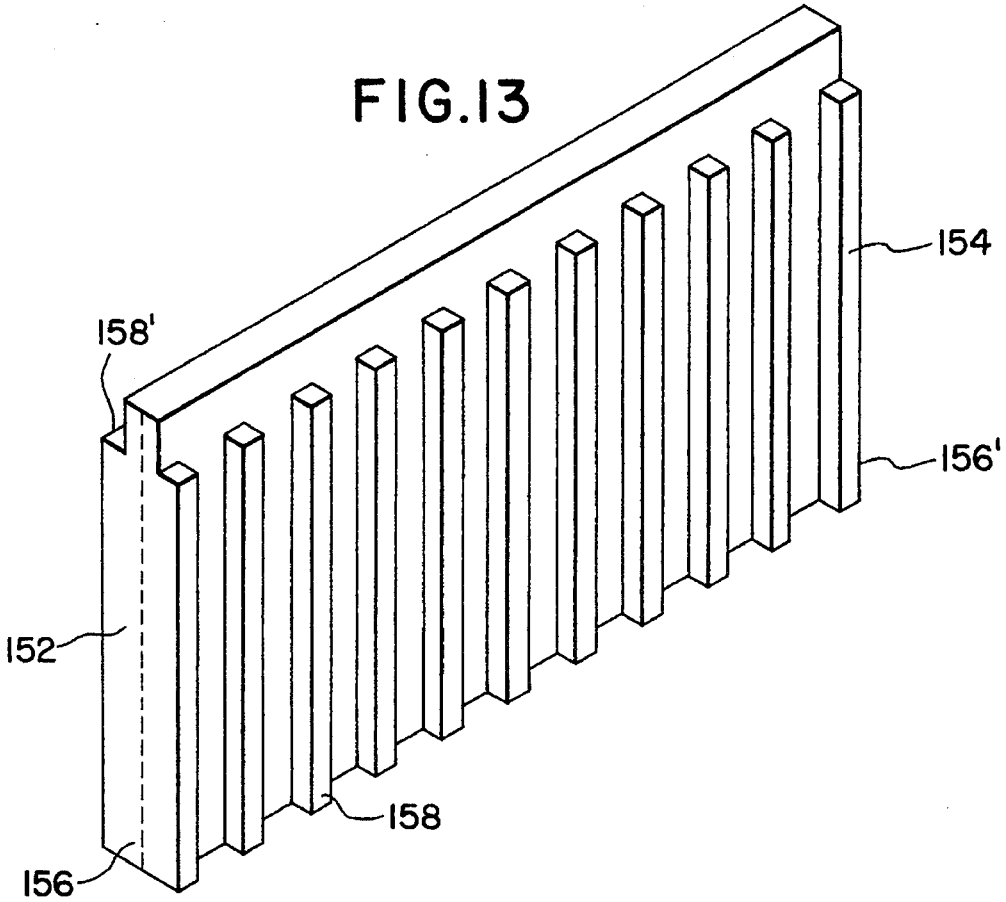
FIG. 13 is a perspective view of an alternative embodiment of a foam block as it emerges from a molding process.
Figure 14:
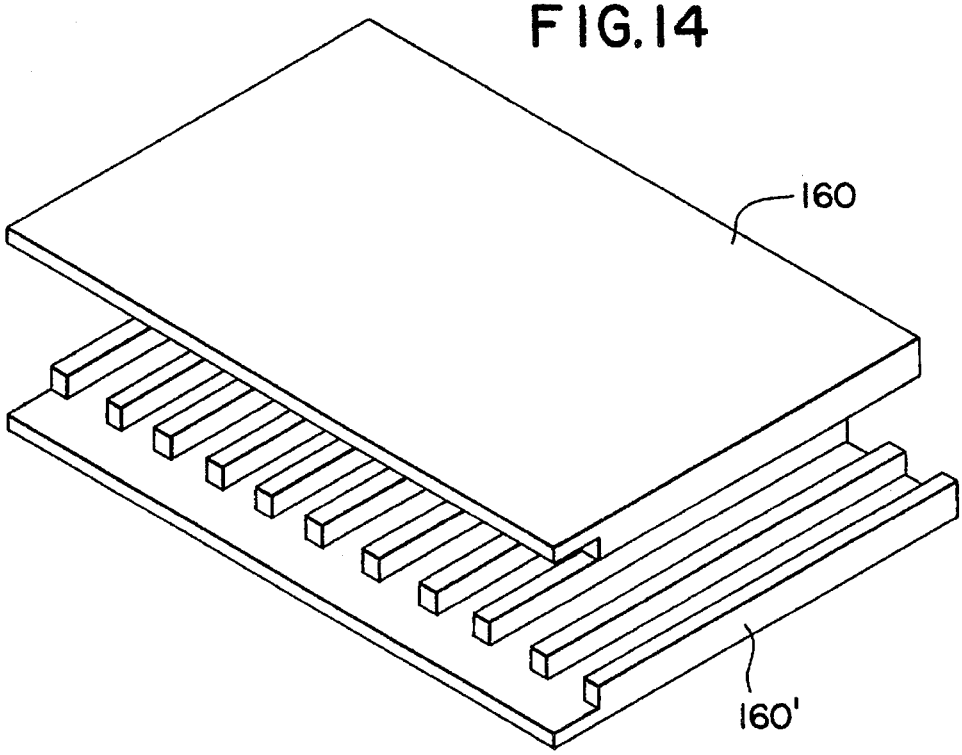
FIG. 14 is an exploded assembly view of an alternative embodiment of the foam block.
Figure 15:
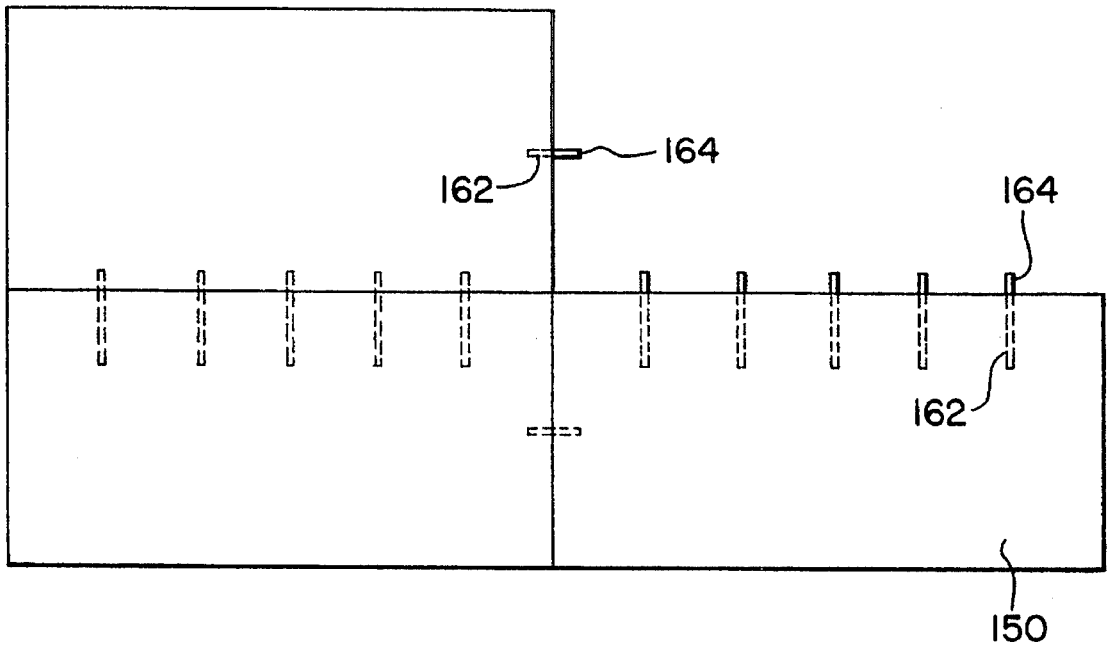
FIG. 15 is a horizontal view of a wall structure constructed in accordance with an alternative embodiment of the foam block.

FIGS. 13, 14, and 15 illustrate an alternative embodiment of the EPS foam block 150. Although this embodiment is substantially similar in its final form to the preferred embodiment, it is formed in a single-piece EPS foam molding process. The block 150 emerges from the mold as a single foam structure 152 with a plurality of vertically oriented quadrilateral columns 154 on each side. The length of the block is defined by the distance between end surfaces 156 and 156'. The width of the block is defined by the distance between the outside faces 158, 158' of the quadrilateral columns 154. The height of the block is defined by the height of the central wall 152. The block is split vertically through its center along the entire length of the block. The resulting halves 160, 160' are inverted and affixed by adhesive to form the finished block 150 as illustrated in FIG. 14.

The molding process of the alternative embodiment provides the ability to include alternative structure for interconnecting the blocks, as illustrated in FIG. 15. The mold may provide for passageways 162 formed in the EPS foam structure of the block which receive interlocking members 164. The interlocking members 164 are rods of steel or other structural material. These rods may serve as to interconnect the blocks in the lateral and vertical dimensions in addition to, or in lieu of, the connectors provided in the preferred embodiment.

What is claimed is:

1. A block system for receiving concrete, comprising:

a plurality of blocks including a first block, a second block and a third block, each of said blocks having a height and a length;

a vertical connector for interconnecting said first and second blocks with said second block being vertically above said first block, said vertical connecter including means disposed outwardly of portions of said first and second blocks for controlling movement of said second block relative to said first block in a direction substantially perpendicular to said height of said first block;

a lateral connector for interconnecting said first block and said third block with said third block being laterally adjacent to said first block, said lateral connector for controlling movement of said third block relative to said first block in a direction substantially perpendicular to said height of said first block; and reinforcing rod means extending along at least a substantial majority of said lengths of said first and third blocks;

wherein each of said first and third blocks includes first and second sidewalls located at ends of each of said first and third blocks, said lateral connector including a platform having a length and at least a first leg that join together said second sidewall of said first block and said first sidewall of said third block and with said platform having a length that extends substantially less than said length of said first block and extends substantially less than said length of said third block, said first leg extending along a height of said second sidewall of said first block and in which said reinforcing rod means has a substantially greater length than said platform and said length of said platform terminates adjacent to each of said second sidewall of said first block and said first sidewall of said third block.

2. A block system for receiving concrete, comprising:

a plurality of blocks including a first block and a second block with each of said blocks having a height that extends in a vertical direction;

a vertical connector for interconnecting said first and second blocks with said second block being vertically above said first block, said vertical connector including first and second retaining members disposed outwardly on opposite sides of said first and second blocks for controlling movement of said second block relative to said first block, each of said first and second retaining members includes an opening with said openings being aligned to receive a support cable, with portions of said support cable being received through each of said openings for supporting said first block during receipt of concrete, and in which said support cable extends outwardly at an angle and downwardly relative to said first and second blocks and with said support cable terminating at a location distant from said first and second blocks.

3. A system, as claimed in claim 1, wherein:

said vertical connector includes at least a first retaining member positioned on an outside surface of said first block and extending in a direction substantially parallel to said height thereof into said second block.

4. A system, as claimed in claim 1, wherein:

said first block includes upper edges having a channel defined therebetween and said third block includes upper edges having a channel defined therebetween with said lateral connector being located in each of said first and third block channels for interconnecting said first and third blocks together.

5. A system, as claimed in claim 1, wherein:

said first block includes a first panel, a second panel and a plurality of core members connected between said first and second panels, each of said core members being substantially quadrilateral in shape.

6. A system, as claimed in claim 1, further comprising:

an exterior connector joined to said first block and extending along at least a portion of said height of said first block, said exterior connector for connecting an element to an outer surface of said first block.

7. A system, as claimed in claim 1, wherein:

said first block includes a first panel and a first core member section integrally formed with said first panel and a second panel having a second core member section integrally formed therewith, said first core member section and said second core member section being connected together.

8. A system, as claimed in claim 1, wherein:

said lateral connector includes a reinforcing rod holder that extends upward from said platform for receiving portions of said reinforcing rod means.

9. A system, as claimed in claim 1, wherein:

said lateral connector includes a second leg that extends along a height of said first sidewall of said second block.

10. A system, as claimed in claim 1, wherein:

said reinforcing rod means has a width and said extending of said first leg along said second sidewall is longer than said width of said reinforcing rod means.

11. A system, as claimed in claim 1, wherein:

said platform is substantially quadrilateral in shape.

* * * * *